US009768569B1

(12) United States Patent
Chang

(10) Patent No.: US 9,768,569 B1
(45) Date of Patent: Sep. 19, 2017

(54) BRACKET ASSEMBLY FOR REINFORCING CONNECTORS ON PRINTED CIRCUIT BOARDS

(71) Applicant: Microsoft Technology Licensing, LLC, Redmond, WA (US)

(72) Inventor: Le Chang, Kirkland, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 15/371,371

(22) Filed: Dec. 7, 2016

(51) Int. Cl.

| | |
|---|---|
| ***H01R 13/60*** | (2006.01) |
| ***H01R 13/66*** | (2006.01) |
| ***H01R 25/00*** | (2006.01) |
| ***H01R 12/72*** | (2011.01) |
| ***H01R 31/00*** | (2006.01) |

(52) U.S. Cl.
CPC ..... *H01R 25/006* (2013.01); *H01R 12/72* (2013.01); *H01R 31/00* (2013.01)

(58) Field of Classification Search
CPC ..... H01R 25/006; H01R 31/00; H01R 12/72
USPC ..... 439/529
See application file for complete search history.

(56) References Cited

U.S. PATENT DOCUMENTS

| | | | | |
|---|---|---|---|---|
| 5,545,057 | A | 8/1996 | Tan et al. | |
| 5,754,404 | A * | 5/1998 | Biermann | H05K 5/0273 361/737 |
| 6,315,610 | B1 | 11/2001 | Zheng et al. | |
| 7,427,213 | B2 | 9/2008 | Kondou et al. | |
| 7,513,786 | B2 | 4/2009 | Muroi et al. | |
| 7,922,534 | B2 | 4/2011 | Lin et al. | |
| 8,535,097 | B2 | 9/2013 | Yen et al. | |
| 2008/0144270 | A1 | 6/2008 | Dal porto et al. | |
| 2013/0078859 | A1 | 3/2013 | Hori et al. | |
| 2016/0028190 | A1 | 1/2016 | Chen et al. | |

OTHER PUBLICATIONS

"REGO: USB 3.1 Type C Connectors", http://www.rego.com.tw/product_detail.php?prdt_id=209, Retrieved Date: Sep. 26, 2016, 1 pages.

* cited by examiner

*Primary Examiner* — Javaid Nasri

(57) ABSTRACT

This document describes a bracket assembly for reinforcing connectors on printed circuit boards. In some aspects, an apparatus is described that includes a device chassis with a stopper feature, a printed circuit board (PCB) attached to the device chassis, and an extended connector assembly mounted to the PCB. The extended connector assembly includes a connector and a connector reinforcing bracket. The connector reinforcing bracket increases a length of the connector to reduce the magnitude of a bending moment induced in the PCB by a connector insertion force. The connector reinforcing bracket also limits deformation of the PCB caused by the connector insertion force.

20 Claims, 6 Drawing Sheets

BRACKET ASSEMBLY FOR REINFORCING CONNECTORS ON PRINTED CIRCUIT BOARDS

BACKGROUND

This background provides context for the disclosure. Unless otherwise indicated, material described in this section is not prior art to the claims in this disclosure and is not admitted to be prior art by inclusion in this section.

Many electronic devices include at least one connector mounted on a printed circuit board (PCB). Mobile phones and tablets, for example, often include data connectors, power connectors, and so forth. When a mating connector is connected to a PCB-mounted connector, an insertion force is applied to the PCB-mounted connector. The PCB-mounted connector is also subject to forces when it is connected to another device (e.g., a mouse dongle, an external memory) that receives a mechanical shock (e.g., a drop or other mishandling of the device).

The insertion and shock forces acting on the PCB-mounted connector can weaken the electrical and mechanical connections between the connector and the PCB, which can lead to chronic intermittent problems with the connector. In some cases, these forces can even disconnect the connector from the PCB. Additionally, the insertion and shock forces can induce a bending moment on the PCB. The deformation of the PCB from the bending moment can damage not only the PCB-mounted connector, but other components mounted on the PCB.

SUMMARY

This summary is provided to introduce simplified concepts that are further described below in the Detailed Description. This summary is not intended to identify essential features of the claimed subject matter, nor is it intended for use in determining the scope of the claimed subject matter.

This document describes techniques and apparatuses implementing a bracket assembly for reinforcing connectors on printed circuit boards in various embodiments. The bracket assembly for reinforcing connectors on printed circuit boards described herein includes a device chassis with a stopper feature and a printed circuit board (PCB) attached to the device chassis. An extended connector assembly is mounted to the PCB, including a PCB-mounted connector and a connector reinforcing bracket. The connector reinforcing bracket includes a bracket mating surface attached to the connector, a bracket-extending member connected to the bracket mating surface, a stopper flange connected to the bracket-extending member, and a PCB mounting contact connected to the bracket-extending member that enable the connector reinforcing bracket to be mounted on the PCB.

When the connector reinforcing bracket is attached to the connector, the bracket-extending member increases a length of the connector in a direction parallel to an insertion axis of a mating connector. The increased length reduces a bending moment induced in the PCB by a connector insertion force applied to the connector when the connector receives a mating connector. The stopper flange limits deformation of the PCB caused by the connector insertion force. The stopper flange limits deformation by contacting the stopper feature of the device chassis when the deformation exceeds a threshold.

BRIEF DESCRIPTION OF THE DRAWINGS

Apparatuses and techniques using a bracket assembly for reinforcing connectors on printed circuit boards are described with reference to the following drawings. The same elements may be shown in different orientations in different figures to provide additional detail or clarity. The same numbers are used throughout the drawings to reference like features and components.

DETAILED DESCRIPTION

Connectors mounted on a printed circuit board (PCB) are used in electronic devices from testing equipment and printers to desktop computers and mobile devices. While common, PCB-mounted connectors are also susceptible to damage that can render the devices unusable. When a mating connector is inserted into a PCB-mounted connector, an insertion force is typically applied to the PCB-mounted connector (similarly, a force may be applied to the PCB-mounted connector when the mating connector is removed). Further, if an external device (e.g., a thumb drive, a quick-charger, or a dongle for a wireless mouse) is inserted in the PCB-mounted connector and the device is then bumped or dropped, a shock force is applied to the PCB-mounted connector. These forces can induce a bending moment in the PCB and cause the PCB to deform. The bending moment can damage the PCB or the components mounted on the PCB. Likewise, the deformation of the PCB can weaken the connection of components mounted on the PCB (including the connector), especially over time as the PCB repeatedly deforms and returns to its normal position with each insertion, removal, or shock force. If the deformation is severe, the connector or other components may even become disconnected from the PCB.

To address these issues with PCB-mounted connectors, this disclosure describes techniques and apparatuses for a bracket assembly for reinforcing connectors on printed circuit boards that implements a connector reinforcing bracket, including a stopper flange, to reduce the bending moment and deformation caused by insertion, removal, and shock forces applied to the PCB-mounted connector during use.

By way of example, consider a connector reinforcing bracket that increases the length of the PCB-mounted connector. The increased length can reduce the distance from the applied force to a point where the PCB is attached to the device in which it operates. The reduced distance decreases the magnitude of a bending moment induced in the PCB. Further, in cases where the device in which the PCB operates includes a stopper feature designed to work with the connector reinforcing bracket, a stopper flange on the connector reinforcing bracket can be configured to limit the deformation of the PCB by making contact with the stopper feature. Reducing the magnitude of the bending moment and limiting the amount of deformation can reduce the likelihood of damaging the PCB and the component connections on the PCB, and lower the risk of disconnections, thereby increasing the reliability and the duty cycle of the PCB and the PCB-mounted connector.

The following discussion describes example systems, various devices that may be included in the example system, and techniques for using the systems and devices. In the discussion below, any reference to an operating environment is only by way of example.

Figure 1:
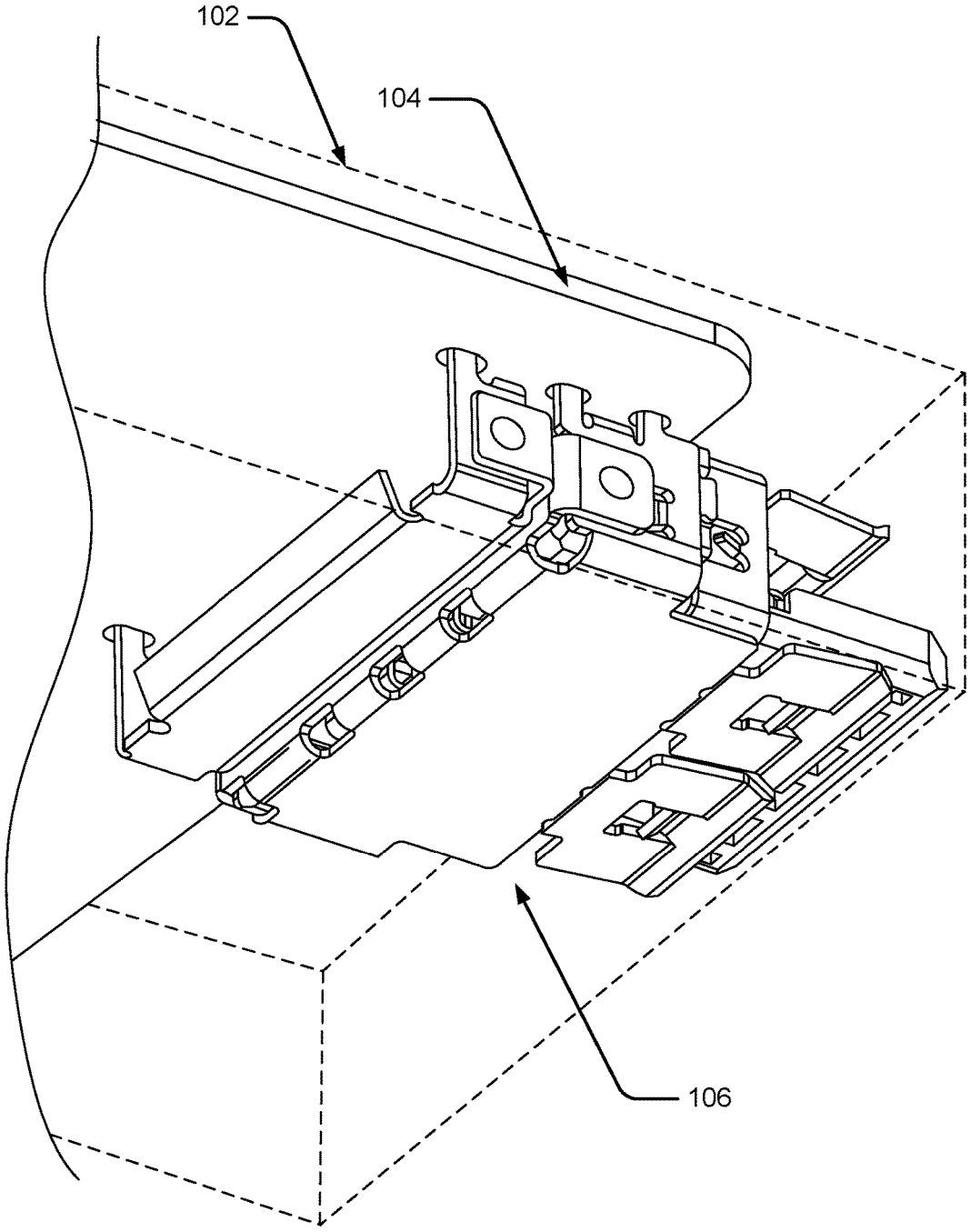
FIG. 1 illustrates an example system in which a bracket assembly for reinforcing connectors on printed circuit boards can be implemented.

FIG. 1 illustrates an example system 100 in which a bracket assembly for reinforcing connectors on printed circuit boards can be implemented. The system 100 includes a device chassis 102 and a printed circuit board (PCB) 104 that is connected to the device chassis 102. The device chassis 102 is shown on FIG. 1 with dashed lines for clarity. The system 100 also includes an extended connector assembly 106 that is mounted on the PCB 104. Additional details and features of the extended connector assembly 106 are described in FIGS. 2 and 3.

Figure 2:
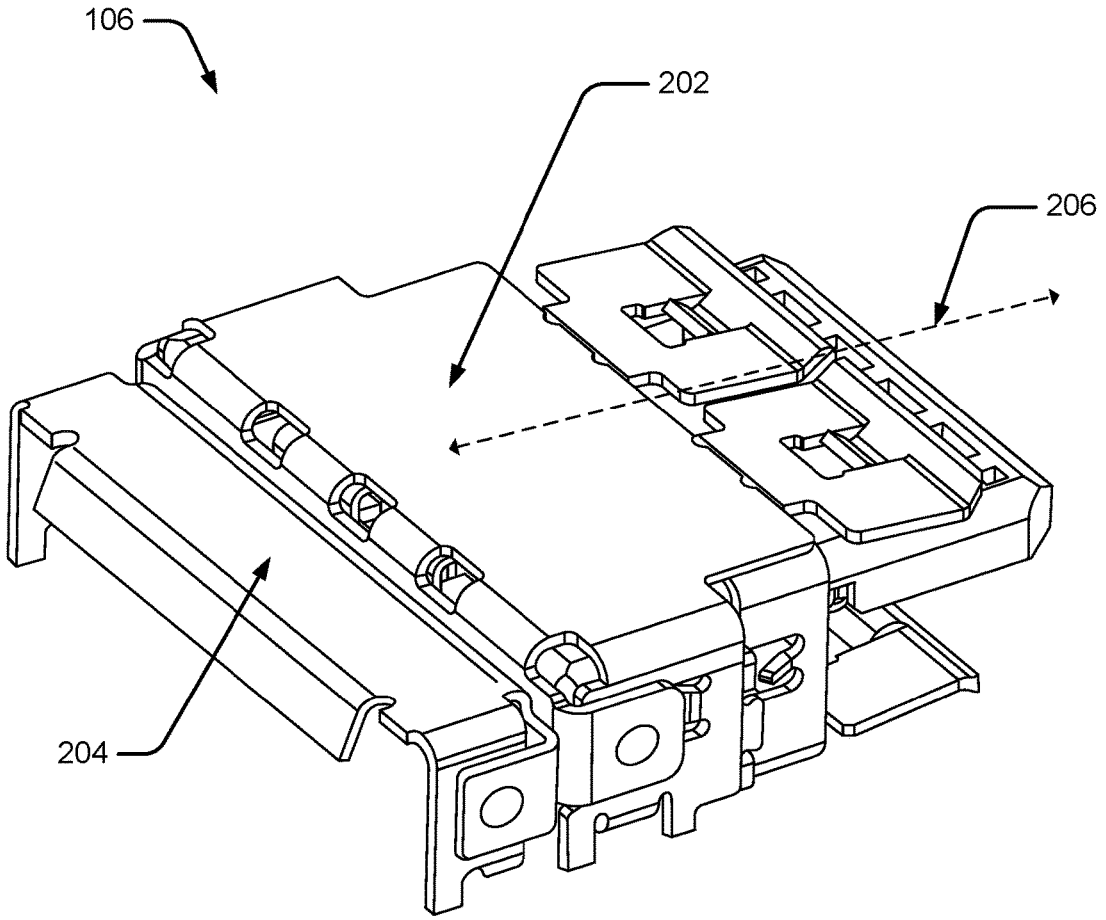
FIG. 2 illustrates additional features and details of an extended connector assembly shown in FIG. 1.

As shown on FIG. 2, the extended connector assembly 106 includes a connector 202 and a connector reinforcing bracket 204. The connector 202 has an insertion axis 206 that illustrates the direction in which a mating connector (not shown) is inserted and removed. The connector 202 can be any type of connector that can be mounted to a PCB. For example, the connector 202 can be a universal serial bus (USB) connector (e.g., USB-A, USB-micro, or USB-mini), a display connector (e.g., a mini display port (mDP) connector or a high-definition multimedia interface (HDMI) connector), or a power supply connector. The connector reinforcing bracket 204 can be made from a variety of materials (e.g., metals, plastics, composites) and can be attached to the PCB using a variety of techniques (e.g., interference fit, threaded fasteners, soldering).

Figure 3:
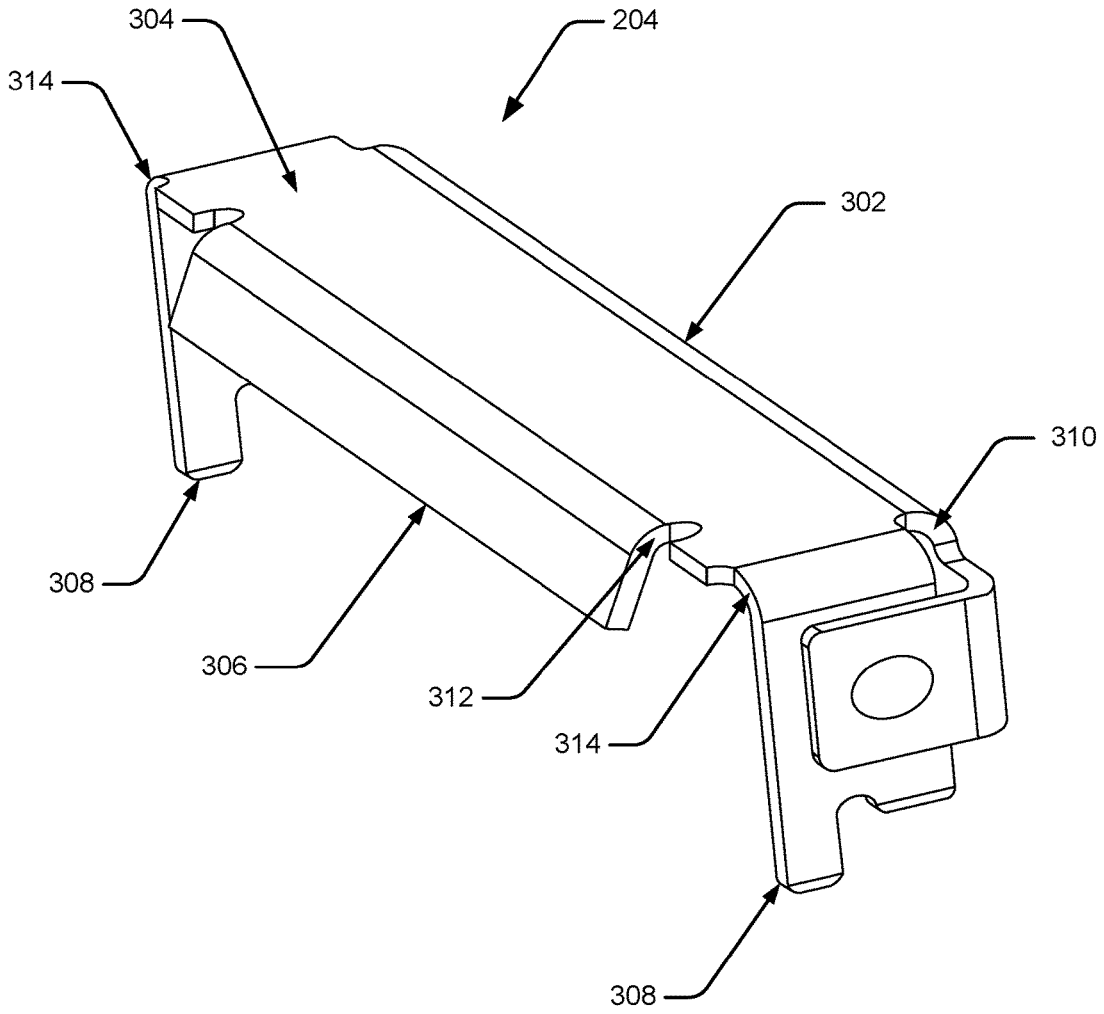
FIG. 3 illustrates an example configuration of a connector reinforcing bracket shown in FIG. 1.

FIG. 3 illustrates an example configuration of the connector reinforcing bracket 204. In the example configuration, the connector reinforcing bracket 204 includes a bracket mating surface 302, a bracket-extending member 304, a stopper flange 306, and two PCB mounting contacts 308 (other configurations of the connector reinforcing bracket 204 may include a different number of PCB mounting contacts). The bracket mating surface 302 is configured to enable the connector reinforcing bracket 204 to be attached to the connector 202. The connector reinforcing bracket 204 can be attached to the connector 202 by one or more of various techniques, including, for example, laser welding, ultrasonic welding, and resistance welding.

The bracket-extending member 304 is connected to the bracket mating surface 302 and enables the extended connector assembly 106 to be longer (in a direction parallel to the insertion axis 206) than the connector 202 by itself. The additional length of the extended connector assembly 106 can reduce a bending moment induced in the PCB 104 that is caused by a connector insertion force that is applied to the connector 202 when the connector 202 receives a mating connector. Further, the stopper flange 306 is connected to the bracket-extending member 304 and is configured to limit deformation of the PCB 104 that is caused by the connector insertion force. Additional details related to the increased length of the extended connector assembly 106 and the deformation limitation provided by the stopper flange 306 are described below with reference to other figures.

The PCB mounting contacts 308 are connected to the bracket-extending member 304 and enable the connector reinforcing bracket 204 to be mounted on the PCB 104. The PCB mounting contacts 308 can be configured enable the connector reinforcing bracket 204 to be mounted using various soldering techniques (e.g., through-hole soldering, surface mount technology (SMT) soldering). As shown in FIGS. 1-3, the PCB mounting contacts 308 enable mounting by through-hole soldering. Through-hole soldering techniques provide additional strength and requires less precision in placing the connector reinforcing bracket 204 compared with, for example, SMT soldering techniques.

Further, in the example configuration of the connector reinforcing bracket 204 shown in FIGS. 1-3, the PCB mounting contacts 308 are configured to space the connector reinforcing bracket 204 away from the surface of the PCB 104 on which it is mounted. For example, the PCB mounting contacts 308 can be configured to give the connector reinforcing bracket 204 a U-shape. As shown in FIG. 1, the U-shape may allow the PCB 104 to be populated with components on the surface under the connector reinforcing bracket 204.

The connector reinforcing bracket 204 can be fabricated using any of a variety of methods. The example configuration of the connector reinforcing bracket 204 shown in FIG. 3 is made from a single piece that is bent to form the finished bracket. In other words, a flat piece is first fabricated using any of a number of techniques (e.g., stamping or laser cutting) and the connector reinforcing bracket 204 is then bent into shape. The bracket-extending member 304 is connected to the bracket mating surface 302 by a bend 310 in the material from which the bracket-extending member 304 and the bracket mating surface 302 are fabricated. Similarly, the stopper flange 306 is connected to the bracket-extending member 304 by a bend 312 and the PCB mounting contacts 308 are connected to the bracket-extending member 304 by bends 314.

In other configurations, the connector reinforcing bracket 204 can be fabricated from individual pieces that are connected using, for example, welding techniques or press-fit techniques. In still other configurations, the connector reinforcing bracket 204 can be fabricated as a single piece using techniques such as casting or injection-molding.

Figure 4:
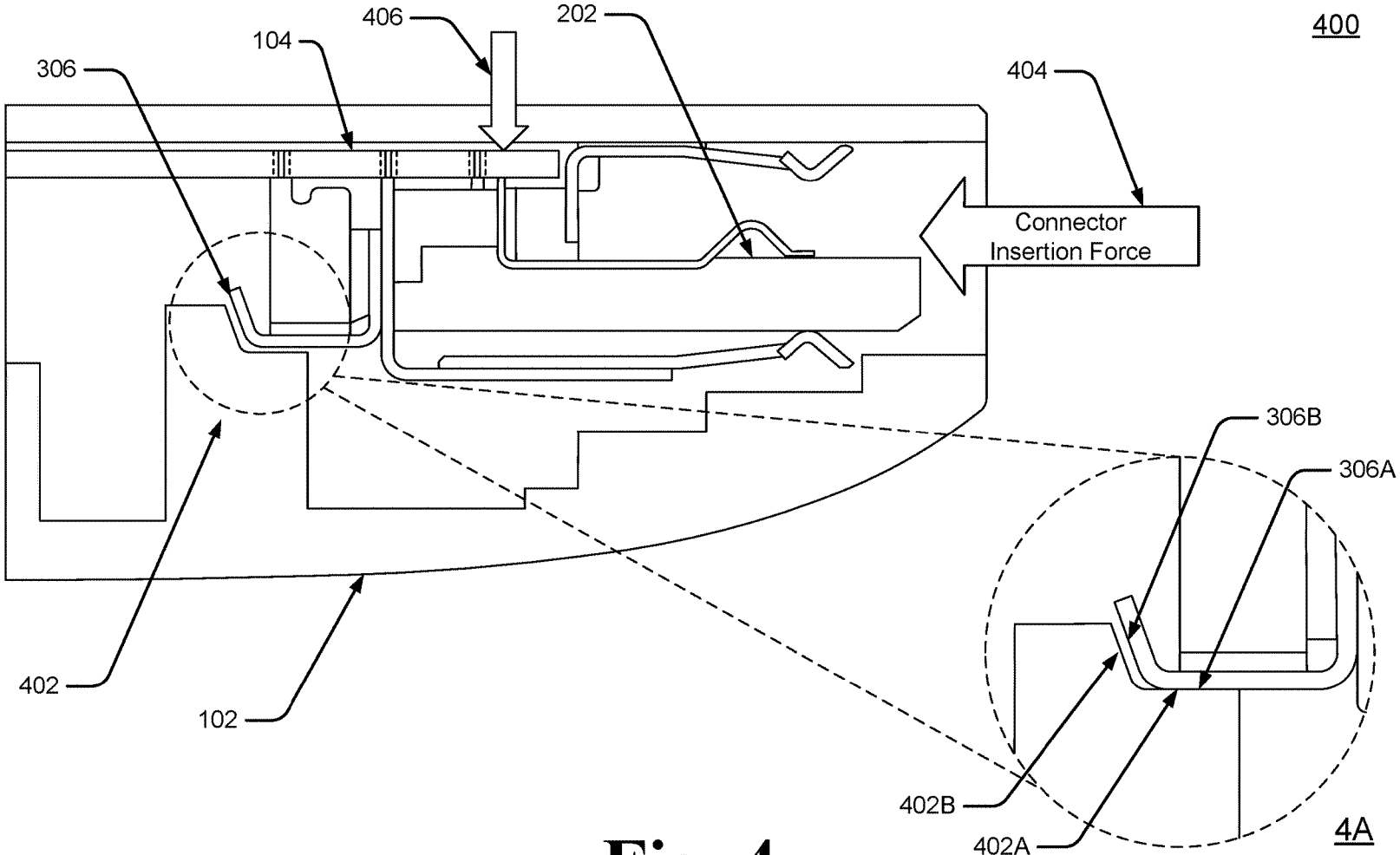
FIG. 4 illustrates a cross section view of the example system shown in FIG. 1.

FIG. 4 illustrates a cross section view 400 of the example system 100 shown in FIG. 1. As shown in FIG. 4, the device chassis 102 includes a stopper feature 402. A connector insertion force, represented by arrow 404, is applied to the connector 202 when a mating connector is connected to the connector 202. A component of the connector insertion force 404 can act to deform the PCB 104 in a direction shown by arrow 406. As noted, this can damage the PCB 104, the connector 202, and other components on the PCB 104. The stopper flange 306 is configured to limit deformation of the PCB 104 caused by the connector insertion force 404 when the stopper flange 306 makes contact with the stopper feature 402.

For example, as shown in detail view 4A of FIG. 4, the surface 306A of the stopper flange 306 contacts the surface 402A of the stopper feature 402 when the PCB 104 deforms in response to the connector insertion force 404. In other configurations, and depending on the direction of the deformation, the surface 306B of the stopper flange 306 will contact the surface 402B of the stopper feature 402, or both of the surfaces 306A and 306B will contact both of the surfaces 402A and 402B, respectively. Thus, the stopper flange 306 and the stopper feature 402 can be configured so that the deformation of the PCB 104 is limited to a threshold value determined by the geometry of the stopper flange 306 and of the stopper feature 402.

Figure 5:
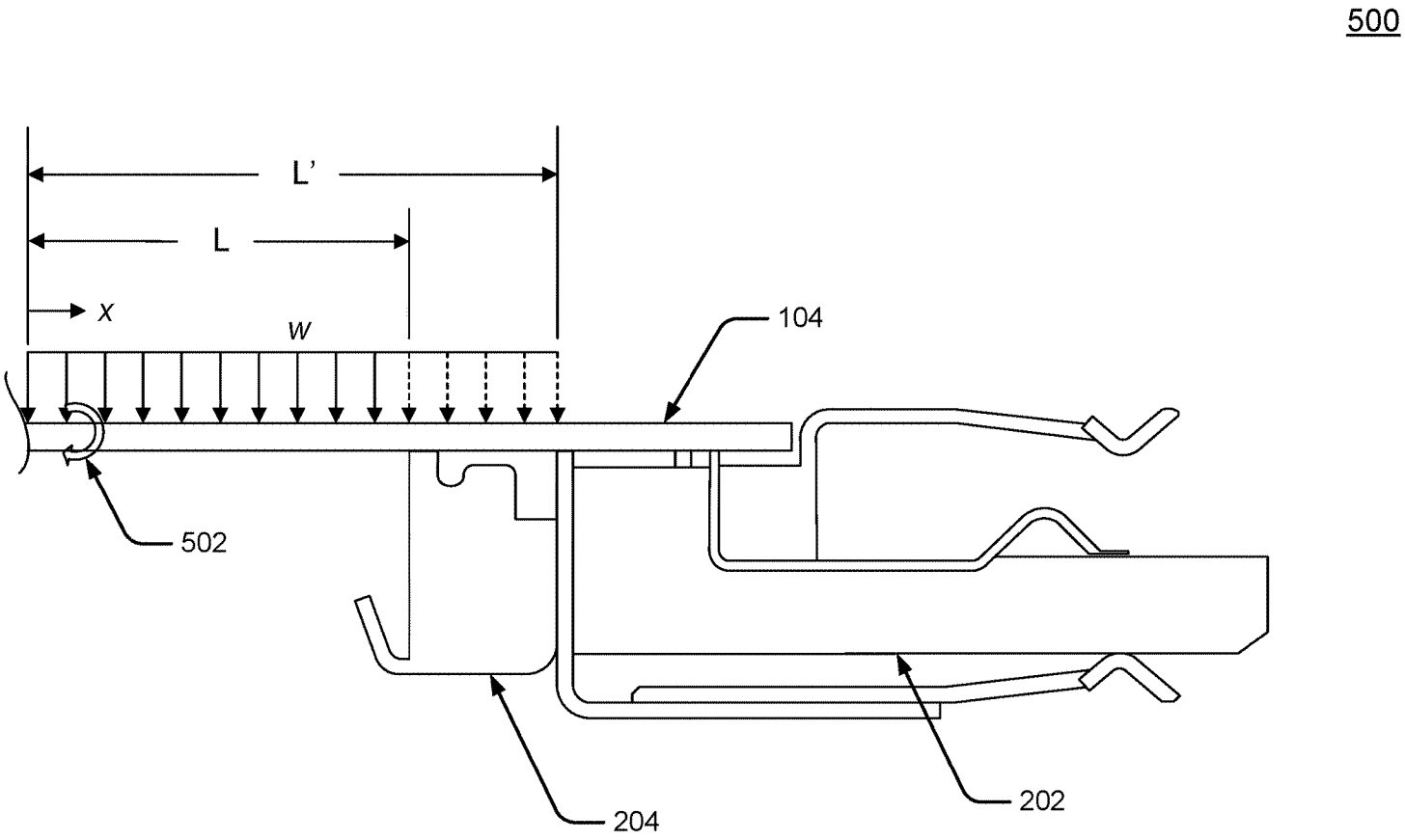
FIG. 5 illustrates additional details of the cross section view shown in FIG. 4, in accordance with one or more aspects.

FIG. 5 illustrates cross section view 500 that depicts additional details of the example system 100 shown in FIG. 1. As noted, a bending moment 502 can be induced in the PCB 104 by a connector insertion force that is applied to the connector 202 when the connector 202 receives a mating connector. The bending moment 502 can damage not only the PCB-mounted connector, but other components mounted on the PCB.

As shown in FIG. 5, the addition of the connector reinforcing bracket 204 to the extended connector assembly 106 increases the length of the extended connector assembly 106 compared with the connector 202 by itself. The additional length of the extended connector assembly 106 can reduce the bending moment 502 induced in the PCB 104. For example, the bending moment formula for a uniformly distributed load (UDL) on a simply supported beam is:

$$M(x) = \frac{w * x}{2} * (L - x)$$

where M(x) is the bending moment at a point x in the beam, w is the magnitude of the UDL and L is the length of the beam. By observation, it can be seen that reducing L reduces the magnitude of the bending moment M(x), at each point, x, in the beam. Applying the above equation to the example system 100 as shown in FIG. 5, and taking the PCB 104 as the simply supported beam, the length L of the PCB 104 with the connector reinforcing bracket 204 is less than the length L' without the connector reinforcing bracket 204. In this way, the term (L−x) is less than (L'−x) and the magnitude of the bending moment 502 is accordingly reduced when the connector reinforcing bracket 204 is attached to the connector 202.

With the structure of the example system 100 detailed, the discussion turns to techniques for building and using the bracket assembly for reinforcing connectors on printed circuit boards. These techniques can be implemented using the previously described apparatuses and example configurations such as the extended connector assembly 106, the connector reinforcing bracket 204 (including the stopper flange 306), and/or the device chassis 102 (including the stopper feature 402).

Figure 6:
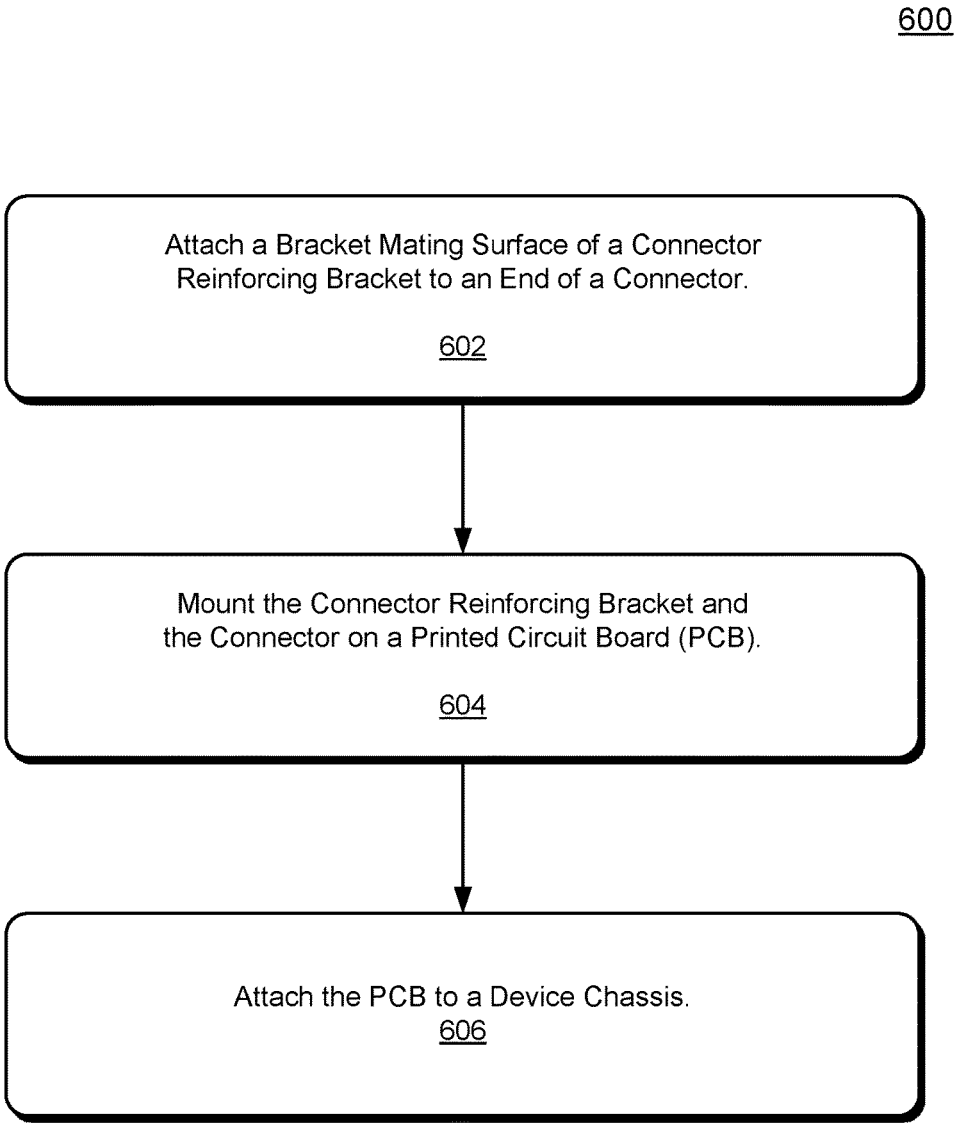
FIG. 6 illustrates an example method for building and using the bracket assembly for reinforcing connectors on printed circuit boards in accordance with one or more aspects.

These techniques include methods illustrated in FIG. 6, operations of which are not necessarily limited to the orders shown. The operations can be looped, repeated, or reordered to implement various aspects described herein. Further, these methods may be used in conjunction with other methods, in whole or in part, whether performed by the same entity, separate entities, or any combination thereof. In portions of the following discussion, reference will be made to the example system 100 as shown in FIGS. 1, 4, and 5, along with the apparatuses and devices of FIGS. 2 and 3. Such reference is not to be taken as limiting the subject matter herein to any example configurations, but rather as illustrative of one of a variety of examples.

FIG. 6 depicts a method 600 for building and using the bracket assembly for reinforcing connectors on printed circuit boards in accordance with one or more aspects. At 602, a bracket mating surface 302 of a connector reinforcing bracket 204 is attached to an end of a connector 202. The bracket mating surface 302 can be attached to the connector 202 by any of a variety of techniques, including laser welding, ultrasonic welding, and resistance welding. The connector 202 has an insertion axis 206 in a direction in which a mating connector is inserted. The connector reinforcing bracket 204 is attached in an orientation that increases a length of the connector 202 in a direction parallel to the insertion axis 206.

The connector reinforcing bracket 204 also includes a bracket-extending member 304 that is connected to the bracket mating surface 302, a stopper flange 306 that is connected to the bracket-extending member 304, and two PCB mounting contacts 308 that are connected the bracket-extending member 304 (as noted, other configurations of the connector reinforcing bracket 204 may include a different number of PCB mounting contacts). As described above, the bracket-extending member 304 is configured to increase the length of the connector 202, which reduces a bending moment induced in the PCB 104 by a connector insertion force 404 that is applied to the connector 202 when the connector 202 receives the mating connector.

As noted, the connector reinforcing bracket 204 can be fabricated using any of a variety of methods. In some configurations, the connector reinforcing bracket 204 is made from a single piece that is bent to form the finished bracket. In those configurations, the bracket-extending member 304 is connected to the bracket mating surface 302 by a bend in a material from which the bracket-extending member and the bracket mating surface are fabricated. Likewise, the stopper flange 306 and the PCB mounting contacts 308 are connected to the bracket-extending member 304 by additional bends in the single piece of material.

At 604, the connector reinforcing bracket 204 and the connector 202 are mounted on a printed circuit board (PCB) 104. As described above, the connector reinforcing bracket can be mounted on the PCB 104 using any of a variety of techniques, including a through-hole soldering technique or a surface mount technology (SMT) soldering technique. In some configurations, the connector reinforcing bracket 204 and the connector 202 are mounted on the PCB such that the connector reinforcing bracket 204 is spaced away from a surface of the PCB 104 enough to enable the PCB 104 to be populated with components on the surface of the PCB under the connector reinforcing bracket 204.

At 606, the PCB 104 is attached to a device chassis 102 that includes a stopper feature 402. The stopper feature 402 is configured such that the stopper flange 306 limits deformation of the PCB 104 induced by the connector insertion force 404. The stopper flange 306 limits the deformation of the PCB 104 by contacting the stopper feature 402 when the deformation exceeds a threshold.

In the discussions herein, various methods and apparatuses are described. It is to be appreciated and understood that each of the methods and apparatuses described herein can be used on its own or in connection with one or more other methods and/or apparatuses described herein. Further aspects of the techniques discussed herein relate to one or more of the following:

A system comprising: a device chassis; a printed circuit board (PCB) attached to the device chassis; and an extended connector assembly mounted to the PCB, the extended connector assembly comprising: a connector having an insertion axis in a direction in which a mating connector is inserted; and a connector reinforcing bracket, the connector reinforcing bracket comprising: a bracket mating surface attached to the connector; a bracket-extending member connected to the bracket mating surface and configured such that attaching the bracket mating surface to the connector increases a length of the connector in a direction parallel to the insertion axis; a stopper flange connected to the bracket-extending member and configured to limit a deformation of the PCB caused by a connector insertion force applied to the connector when the connector receives a mating connector; and a PCB mounting contact connected to the bracket-extending member, the PCB mounting contact configured to enable the connector reinforcing bracket to be mounted on the PCB.

Alternatively or in addition to any of the above described systems, any one or combination of: wherein the device chassis includes a stopper feature; and the stopper flange is configured to limit the deformation of the PCB by contacting the stopper feature when the deformation exceeds a threshold; the bracket-extending member further configured such that increasing the length of the connector in the direction parallel to the insertion axis reduces a bending moment induced in the PCB by the connector insertion force; the PCB mounting contact further configured to space the connector reinforcing bracket away from a surface of the PCB to enable population of the PCB with components on the surface of the PCB under the connector reinforcing bracket; the PCB mounting contact further configured to enable the connector reinforcing bracket to be mounted on the PCB via one of: a through-hole soldering technique and a surface mount technology soldering technique; wherein: the bracket-extending member is connected to the bracket mating surface by a first bend in a material from which the bracket-extending member and the bracket mating surface are fabricated; and the stopper flange is connected to the bracket-extending member by a second bend in the material from which the stopper flange and the bracket-extending member are fabricated; and the PCB mounting contact is connected to the bracket-extending member by a third bend in the material from which the PCB mounting contact and the bracket-extending member are fabricated; the bracket mating surface attached to the connector by a laser weld, an ultrasonic weld, or a resistance weld.

A method comprising: attaching a bracket mating surface of a connector reinforcing bracket to an end of a connector having an insertion axis in a direction in which a mating connector is insertable, the connector reinforcing bracket attached in an orientation that increases a length of the connector in a direction parallel to the insertion axis, the connector reinforcing bracket further including a bracket-extending member connected to the bracket mating surface, a PCB mounting contact connected to the bracket-extending member, and a stopper flange connected to the bracket-extending member; mounting the connector reinforcing bracket and the connector on a printed circuit board (PCB); and attaching the PCB to a device chassis that includes a stopper feature, the stopper feature configured such that the stopper flange limits deformation of the PCB induced by a connector insertion force applied to the connector when the connector receives the mating connector, the deformation limited by the stopper flange contacting the stopper feature when the deformation exceeds a threshold.

Alternatively or in addition to any of the above described methods, any one or combination of: the bracket-extending member configured such that the increased length of the connector acts to reduce a bending moment induced in the PCB by the connector insertion force; the mounting comprising mounting the connector reinforcing bracket and the connector on the PCB such that the connector reinforcing bracket is spaced away from a surface of the PCB to enable population of the PCB with components on the surface of the PCB under the connector reinforcing bracket; further comprising mounting the connector reinforcing bracket on the PCB via the PCB mounting contact, using one or more of a through-hole soldering technique and a surface mount technology soldering technique; wherein: the bracket-extending member is connected to the bracket mating surface by a first bend in a material from which the bracket-extending member and the bracket mating surface are fabricated; the stopper flange is connected to the bracket-extending member by a second bend in the material from which the stopper flange and the bracket-extending member are fabricated; and the PCB mounting contact is connected to the bracket-extending member by a third bend in the material from which the PCB mounting contact and the bracket-extending member are fabricated; further comprising attaching the bracket mating surface to the end of the connector by laser welding, ultrasonic welding, or resistance welding.

An extended connector assembly to reduce deformation of a printed circuit board (PCB) from a connector insertion force applied to the extended connector assembly when mounted on the PCB and receiving a mating connector, the extended connector assembly comprising: a connector having an insertion axis in a direction in which the mating connector is inserted; and a connector reinforcing bracket, the connector reinforcing bracket comprising: a bracket mating surface attached to the connector; a bracket-extending member connected to the bracket mating surface and configured such that attaching the bracket mating surface to the connector increases a length of the connector in a direction parallel to the insertion axis; a stopper flange connected to the bracket-extending member and configured to limit the deformation of the PCB; and a PCB mounting contact connected to the bracket-extending member, the PCB mounting contact configured to enable the connector reinforcing bracket to be mounted on the PCB.

Alternatively or in addition to any of the above described extended connector assemblies, any one or combination of: the bracket-extending member further configured such that the increased length of the connector in the direction parallel to the insertion axis acts to reduce a bending moment induced in the PCB by the connector insertion force; the deformation of the PCB limited by the stopper flange contacting a stopper feature when the deformation exceeds a threshold, the stopper feature included on a device chassis on which the PCB is mounted; the PCB mounting contact further configured to space the connector reinforcing bracket away from a surface of the PCB to enable population of the PCB with components on the surface of the PCB under the connector reinforcing bracket; the PCB mounting contact further configured to enable the connector reinforcing bracket to be mounted on the PCB via one or more of a through-hole soldering technique and a surface mount technology soldering technique; wherein: the bracket-extending member is connected to the bracket mating surface by a first bend in a material from which the bracket-extending member and the bracket mating surface are fabricated; the stopper flange is connected to the bracket-extending member by a second bend in the material from which the stopper flange and the bracket-extending member are fabricated; and the PCB mounting contact is connected to the bracket-extending member by a third bend in the material from which the PCB mounting contact and the bracket-extending member are fabricated; the bracket mating surface attached to the connector with a laser weld, an ultrasonic weld, or a resistance weld.

Although implementations of techniques and apparatuses enabling a bracket assembly for reinforcing connectors on printed circuit boards have been described in language specific to features and/or methods, it is to be understood that the subject of the appended claims is not necessarily limited to the specific features or methods described. Rather, the specific features and methods are disclosed as example implementations enabling the bracket assembly for reinforcing connectors on printed circuit boards.

What is claimed is:

1. A system comprising:

a device chassis;

a printed circuit board (PCB) attached to the device chassis; and an extended connector assembly mounted to the PCB, the extended connector assembly comprising:

a connector having an insertion axis in a direction in which a mating connector is inserted; and a connector reinforcing bracket, the connector reinforcing bracket comprising:

a bracket mating surface attached to the connector;

a bracket-extending member connected to the bracket mating surface and configured such that attaching the bracket mating surface to the connector increases a length of the connector in a direction parallel to the insertion axis;

a stopper flange connected to the bracket-extending member and configured to limit a deformation of the PCB caused by a connector insertion force applied to the connector when the connector receives a mating connector; and a PCB mounting contact connected to the bracket-extending member, the PCB mounting contact configured to enable the connector reinforcing bracket to be mounted on the PCB.

2. The system as described in claim 1, wherein:

the device chassis includes a stopper feature; and the stopper flange is configured to limit the deformation of the PCB by contacting the stopper feature when the deformation exceeds a threshold.

3. The system as described in claim 1, the bracket-extending member further configured such that increasing the length of the connector in the direction parallel to the insertion axis reduces a bending moment induced in the PCB by the connector insertion force.

4. The system as described in claim 1, the PCB mounting contact further configured to space the connector reinforcing bracket away from a surface of the PCB to enable population of the PCB with components on the surface of the PCB under the connector reinforcing bracket.

5. The system as described in claim 1, the PCB mounting contact further configured to enable the connector reinforcing bracket to be mounted on the PCB via one of: a through-hole soldering technique and a surface mount technology soldering technique.

6. The system as described in claim 1, wherein:

the bracket-extending member is connected to the bracket mating surface by a first bend in a material from which the bracket-extending member and the bracket mating surface are fabricated; and the stopper flange is connected to the bracket-extending member by a second bend in the material from which the stopper flange and the bracket-extending member are fabricated; and the PCB mounting contact is connected to the bracket-extending member by a third bend in the material from which the PCB mounting contact and the bracket-extending member are fabricated.

7. The system as described in claim 1, the bracket mating surface attached to the connector by a laser weld, an ultrasonic weld, or a resistance weld.

8. A method comprising:

attaching a bracket mating surface of a connector reinforcing bracket to an end of a connector having an insertion axis in a direction in which a mating connector is insertable, the connector reinforcing bracket attached in an orientation that increases a length of the connector in a direction parallel to the insertion axis, the connector reinforcing bracket further including a bracket-extending member connected to the bracket mating surface, a PCB mounting contact connected to the bracket-extending member, and a stopper flange connected to the bracket-extending member;

mounting the connector reinforcing bracket and the connector on a printed circuit board (PCB); and attaching the PCB to a device chassis that includes a stopper feature, the stopper feature configured such that the stopper flange limits deformation of the PCB induced by a connector insertion force applied to the connector when the connector receives the mating connector, the deformation limited by the stopper flange contacting the stopper feature when the deformation exceeds a threshold.

9. The method as described in claim 8, the bracket-extending member configured such that the increased length of the connector acts to reduce a bending moment induced in the PCB by the connector insertion force.

10. The method as described in claim 8, the mounting comprising mounting the connector reinforcing bracket and the connector on the PCB such that the connector reinforcing bracket is spaced away from a surface of the PCB to enable population of the PCB with components on the surface of the PCB under the connector reinforcing bracket.

11. The method as described in claim 8, further comprising mounting the connector reinforcing bracket on the PCB via the PCB mounting contact, using one or more of a through-hole soldering technique and a surface mount technology soldering technique.

12. The method as described in claim 8, wherein:

the bracket-extending member is connected to the bracket mating surface by a first bend in a material from which the bracket-extending member and the bracket mating surface are fabricated;

the stopper flange is connected to the bracket-extending member by a second bend in the material from which the stopper flange and the bracket-extending member are fabricated; and the PCB mounting contact is connected to the bracket-extending member by a third bend in the material from which the PCB mounting contact and the bracket-extending member are fabricated.

13. The method as described in claim 8, further comprising attaching the bracket mating surface to the end of the connector by laser welding, ultrasonic welding, or resistance welding.

14. An extended connector assembly to reduce deformation of a printed circuit board (PCB) from a connector insertion force applied to the extended connector assembly when mounted on the PCB and receiving a mating connector, the extended connector assembly comprising:

a connector having an insertion axis in a direction in which the mating connector is inserted; and a connector reinforcing bracket, the connector reinforcing bracket comprising:

a bracket mating surface attached to the connector;

a bracket-extending member connected to the bracket mating surface and configured such that attaching the bracket mating surface to the connector increases a length of the connector in a direction parallel to the insertion axis;

a stopper flange connected to the bracket-extending member and configured to limit the deformation of the PCB; and a PCB mounting contact connected to the bracket-extending member, the PCB mounting contact configured to enable the connector reinforcing bracket to be mounted on the PCB.

15. The extended connector assembly as described in claim 14, the bracket-extending member further configured such that the increased length of the connector in the direction parallel to the insertion axis acts to reduce a bending moment induced in the PCB by the connector insertion force.

16. The extended connector assembly as described in claim 14, the deformation of the PCB limited by the stopper flange contacting a stopper feature when the deformation exceeds a threshold, the stopper feature included on a device chassis on which the PCB is mounted.

17. The extended connector assembly as described in claim 14, the PCB mounting contact further configured to space the connector reinforcing bracket away from a surface of the PCB to enable population of the PCB with components on the surface of the PCB under the connector reinforcing bracket.

18. The extended connector assembly as described in claim 17, the PCB mounting contact further configured to enable the connector reinforcing bracket to be mounted on the PCB via one or more of a through-hole soldering technique and a surface mount technology soldering technique.

19. The extended connector assembly as described in claim 14, wherein:

the bracket-extending member is connected to the bracket mating surface by a first bend in a material from which the bracket-extending member and the bracket mating surface are fabricated;

the stopper flange is connected to the bracket-extending member by a second bend in the material from which the stopper flange and the bracket-extending member are fabricated; and the PCB mounting contact is connected to the bracket-extending member by a third bend in the material from which the PCB mounting contact and the bracket-extending member are fabricated.

20. The extended connector assembly as described in claim 14, the bracket mating surface attached to the connector with a laser weld, an ultrasonic weld, or a resistance weld.

* * * * *